US005727316A

United States Patent [19]

Riendeau

[11] Patent Number: 5,727,316

[45] Date of Patent: Mar. 17, 1998

[54] METHOD OF MANUFACTURING A SCREEN CYLINDER AND A SCREEN CYLINDER PRODUCED BY THE METHOD

[75] Inventor: Jacques Riendeau, Brompton, Canada

[73] Assignee: CAE Screenplates Inc., Quebec, Canada

[21] Appl. No.: 656,323

[22] PCT Filed: Dec. 9, 1994

[86] PCT No.: PCT/CA94/00677

§ 371 Date: Jun. 12, 1996

§ 102(e) Date: Jun. 12, 1996

[87] PCT Pub. No.: WO95/16819

PCT Pub. Date: Jun. 22, 1995

[30] Foreign Application Priority Data

Dec. 13, 1993 [CA] Canada ..... 2111147

[51] Int. Cl.[6] ..... B01D 39/10

[52] U.S. Cl. ..... 29/896.62; 209/397; 210/498

[58] Field of Search ..... 29/896.61, 896.62; 209/270, 273, 397; 210/497.01, 497.1, 497.2, 498

[56] References Cited

U.S. PATENT DOCUMENTS

| | | | |
|---|---|---|---|
| 3,520,418 | 7/1970 | Guinard | 210/498 |
| 3,631,981 | 1/1972 | Young . | |
| 3,664,502 | 5/1972 | Nichols | 209/397 |
| 3,941,703 | 3/1976 | Binard . | |
| 3,957,652 | 5/1976 | McGonigal | 210/498 |
| 4,259,136 | 3/1981 | Spiewok . | |
| 4,264,438 | 4/1981 | Frejborg . | |
| 4,406,326 | 9/1983 | Wagner | 29/896.61 X |
| 4,529,520 | 7/1985 | Lampenius | 210/498 |
| 4,901,417 | 2/1990 | Chupka et al. | 29/896.62 |
| 4,918,807 | 4/1990 | Frejborg | 29/896.62 |
| 4,932,112 | 6/1990 | Tikkanen | 29/896.62 |
| 5,023,986 | 6/1991 | Gero et al. | 29/896.62 X |
| 5,059,324 | 10/1991 | Chen | 210/498 X |
| 5,064,537 | 11/1991 | Chupka et al. . | |
| 5,073,254 | 12/1991 | Peisenherz et al. | 210/498 X |
| 5,128,028 | 7/1992 | Lamort . | |
| 5,200,072 | 4/1993 | Frejborg et al. . | |
| 5,513,757 | 5/1996 | Papetti | 210/498 X |
| 5,524,770 | 6/1996 | LeBlane et al. | 209/397 X |
| 5,587,077 | 12/1996 | Aaltonen et al. | 29/896.62 X |

FOREIGN PATENT DOCUMENTS

| | | |
|---|---|---|
| 4107905 | 9/1992 | Germany . |
| 562087 | 5/1942 | United Kingdom . |

*Primary Examiner*—Daniel Moon
*Attorney, Agent, or Firm*—Nixon & Vanderhye P.C.

[57] ABSTRACT

A method is disclosed for the manufacture of screen cylinders, e.g. for removal of debris such as sand, rock, metal, resin etc. from a liquid suspension used in the pulp and paper industry. The screen is of the type having a plurality of slot passages, each extending axially the entire axial length of the cylinder. According to the invention, the width of the slots is controlled by determining the physical structure of the screen, particularly the overall thickness of the screen and the backing reinforcement ribs, prior to the rolling of the screen plate into a cylinder. A table of a number of different sizes is included showing the practical range of application of the invention. The invention allows the use of standard cutters used in the milling of the slots for the production of screens with much narrower slots to obtain an improved degree of removal of contaminants without having to use specially thin cutters. Screens produced by the method are also claimed.

17 Claims, 7 Drawing Sheets

METHOD OF MANUFACTURING A SCREEN CYLINDER AND A SCREEN CYLINDER PRODUCED BY THE METHOD

BACKGROUND OF THE INVENTION

The present invention relates to the manufacture of screen cylinders. Screen cylinders of the type to which the present invention pertains are typically used in removal of debris such as sand, rocks, metal pieces, resin etc. from a liquid suspension, for instance a fibrous stock used in pulp or paper making. The cylinders form a part of s screening device in which the slurry to be screened flows inside the cylinder and is forced to flow through the slotted screen. The inside of the cylinder is usually subjected to the action of hydraulic foils or the like agitating device which are used to further advance the screening efficiency by preventing the clogging of the screening slots.

The following United States patents also describe the field to which the present invention pertains: U.S. Pat. Nos. 3,941,703 (Binard), 3,631,981 (Young), 4,259,136 (Spiewok), 4,264,438 (Frejborg) and 5,064,537 (Chupka et al.) and 5,128,028 (Lamort), 5,200,072 (Frejborg). The disclosure of all of the above patents is incorporated herein by reference.

It is known, from the '072 Frejborg patent, to provide a screen drum by machining in one face of a stainless steel rectangular plate a plurality of grooves extending from one end of the plate to the other, to then machine, in the other face, narrow slots extending each full width, from one side of the plate to the other. The slots provide screening passages through the plate. The narrow slots extend generally at right angles to the grooves. The plate is then rolled into a cylinder, with the face in which the slots were machined inside. The ends of the plate are then welded to each other to enclose the screen cylinder. The machining of the grooves results in a number of peripheral ribs on the cylinder, each disposed between adjacent grooves.

German Offenlegungsschrift 41 07 905 (Sulzer-Escher Wyss) refers to the common general knowledge, namely that slots cut in a screen body are reduced in width when the body is rolled into a cylindric shape. The displacement of the neutral bend line due to the presence of ribs on the screen is also mentioned. Yet, viewed from the standpoint of the present invention, there is no recognition that the final width of the screening slots in the finished, cylindric screen can be controlled simply by selecting appropriate height of the prior to the rolling.

The width of the screen slots at the inlet end of each slot determines the degree of removal of contaminants from the screened stock. The smaller the width, the higher the degree of removal of rejects. Viewed from the standpoint of manufacture of the screens, the width of the slots depends mainly on the thickness of the circular cutter used in the milling of the slots. At the inlet end of each slot, a specifically shaped groove may be machined but the ultimate determining size of the slot passage is still the width of the inlet portion of the slot at the bottom of the profiled groove.

The minimum thickness of commercially available circular cutters used in machining the slots in screen plates is 0.15 mm (0.006 in.). The manufacturers of the screens prefer a somewhat thicker cutter as it is less prone to breaking during the machining process. The desired width of the slot in the rolled cylinder, however, prevented the use of thicker cutters to maintain the prescribed, relatively narrow width of the slots in order to secure the desired screening capability.

It is an object of the present invention to further advance the art of cylindric screen manufacture by providing a method of manufacture; and a product made by such method, where the ultimate width of the inlet end of the slots can be reduced, within practical limits, without having to use special thin cutters in machining the slots.

It is another object of the invention to provide a method of making a cylindric screen or to provide a cylindric screen produced by the method, where the ultimate width of the inlet part of the screen slots can be selectively controlled such that the same width of the slots in the planar plate prior to its rolling into the cylindric shape of a given inside diameter, results in selectively predetermined different width of the slots at their inlet depending upon the desired application of the screen.

It is yet another object of the invention to reduce the cost of manufacture of cylindric screen plates of the type described by reducing the number of required raw plates of different thickness for the production of the screens, and by allowing the use of thinner raw plates than those used when producing the screens under the presently known practice.

Last but not least, it is an object of the invention to provide a method and a product, where the width of the inlet end of the screen slots is selectively smaller than the thickness of the circular cutters used in the machining of the slots in a planar plate, prior to the rolling into a cylinder.

SUMMARY OF THE INVENTION

In general terms, the present invention provides a method of manufacturing a screen cylinder having a given inside diameter within the range of about 10 in. (250 mm) to about 60 in. (1500 mm), comprising the steps of:

(a) providing a generally rectangular metallic plate having a known thickness t, a first end, a second end and two opposed sides, an inlet face and an opposed, outlet face;

(b) providing in said second face a plurality of generally straight, spaced apart channels parallel with each other and being of a generally uniform depth, said channels extending in the general direction from one said end to the other, a rib being disposed between each pair of adjacent channels, said ribs having a predetermined height h measured in the direction perpendicular to the plate and being generally equal to the depth $d_2$ of the channels;

(c) providing in said first face a plurality of spaced apart, straight, continuous slots having each a width w and extending full width of the plate, from one side of the plate to the other, said slots partially intersecting said ribs to define therein groove-like portions of the slots;

(d) controlling the magnitude of a variable $w_f$ by determining an appropriate height h of the ribs from a formula:

$$h+\Delta h \propto \Delta w$$

wherein

Δh is an increase in the height h of the ribs; and

Δw is the desired reduction of the width w upon rolling the plate into a cylindric shape, to reach $w_f$;

(e) rolling the plate into a cylindric shape with said ends of the plate forming axial ends of the cylindric shape; and (f) fixedly securing the sides of the plate to each other to enclose said cylindric shape.

In another aspect, but still defining the invention in general terms, a method is provided of manufacturing a cylindric screen, comprising the steps of (a) providing an integral, metallic, generally planar, rectangular screen plate having the length, as measured between its ends, from about 33 in. (800 mm)to about 190 in. (4800 mm) which plate includes:

(1) an inlet surface;

(2) an opposed outlet surface;

(3) a plurality of straight, parallel slots extending from one side of the plate to the other, said slots providing each a passage of a generally uniform cross-section through said plate, the slots having each a width from about 0.006 in. to about 0.014 in., the spacing between the slots corresponding to a pitch of about 4 slots per inch (6 mm spacing) to about 10 slots per inch (2.5 mm spacing);

(4) a plurality of transversely disposed backing ribs projecting from said outlet surface and extending each from one end of the plate to the other, the height (h) of the ribs as measured in the direction from one said surface to the other, being about 0.25 inch (6 mm);

(b) increasing the height of each of said ribs by fixedly securing to an outer face thereof an additional bar of metallic material, to thus increase the overall height of each said rib to a total height from about 0.25 in. (6 mm) to about 1 in. (25 mm);

(c) rolling the plate with thus modified height of said ribs into a cylinder where said inlet surface is at the inside of the cylinder and the ends of the plate define axial ends of the cylinder; and (d) fixedly securing the ends of the plate to each other to enclose the cylinder;

whereby, upon rolling the plate into a cylindric shape, the width of the slots at said inlet surface is reduced by about 0.002 in. (0.05 mm) to about 0.010 in. (0.25 mm) depending upon the thickness of the plate, the diameter of the cylinder, the spacing between the slots and the height of the backing ribs.

The invention can also be generally defined as a method of manufacturing a screen cylinder having a given inside diameter within the range of about 10 in. (250 mm) to about 60 in. (1500 mm), comprising the steps of:

(a) providing a generally rectangular plate having a first end, a second end and two opposed sides, a first face and an opposed, second face;

(b) said first face being provided with a plurality of continuous, spaced apart ribs each rib having two sides and a ridge section, said ribs being integral with or fixedly secured to the plate at the first face, having a height h and being disposed in a substantially parallel, spaced apart relationship, the ribs forming sides of channels extending in the general direction from one said end of the plate to the other;

(c) each channel thus having two opposed side walls formed by the sides of said ribs, and a bottom wall; the channels having a predetermined depth $d_2$ generally corresponding to the distance between said bottom walls and said ridge sections of the ribs, and thus corresponding to said height h of the ribs;

(d) forming a plurality of parallel slots extending full width of said plate, from one said side to the other and disposed at an angle to said channels each slot having an inlet portion at said second face, and an outlet portion at said first face;

(e) each slot passing fully through said bottom walls of said channels and intersecting each said rib by way of a blind groove section;

(f) each blind groove section having a groove bottom at a predetermined distance $d_1$ from the inlet portion of the respective slot as measured perpendicularly to the plate, the value of $d_1$ corresponding to the formula $$(d_3-d_1)\leqq h$$

wherein $d_3$ is the distance measured across the thickness of the plate, from the inlet portion of the respective slot to the ridge section of the respective rib;

and $d_1$ and h are variables as described above; and (g) rolling the plate into a cylinder wherein said sides are at respective axial ends of the cylinder; and (h) fixedly securing said ends to each other to enclose said cylinder;

said method being characterized in that a desired value of the reduction in the width of the slots at said inlet portions thereof upon rolling the plate into said cylindric screen is effected by steps including the step of selecting the value of $(d_3-d_1)$ using the formula $$(d_3+d_1)\propto\Delta w;$$

wherein $\Delta w$ is the reduction in the width of the slots at said inlet portion thereof upon rolling the plate into a cylindric screen; and $d_1$ and $d_3$ are variables as described above.

An exemplary embodiment of the product of the cylindric screen in accordance with the present invention can be generally defined as a cylindric screen comprising, in combination, a plurality of straight slot-shaped passages through a cylindric wall, from an inside surface of the screen to an outside surface thereof, each passage extending full axial length of the cylindric screen, said screen further comprising a plurality of backing ribs disposed peripherally at the outside surface of the screen, wherein said backing ribs are each comprised of an inner section integral with the cylindric wall, and an outer section fixedly secured to the inner section.

BRIEF DESCRIPTION OF THE DRAWINGS

The invention will be described by way of preferred embodiments, with reference to the accompanying simplified, diagrammatic, not-to-scale drawings, wherein.

Figure 11:
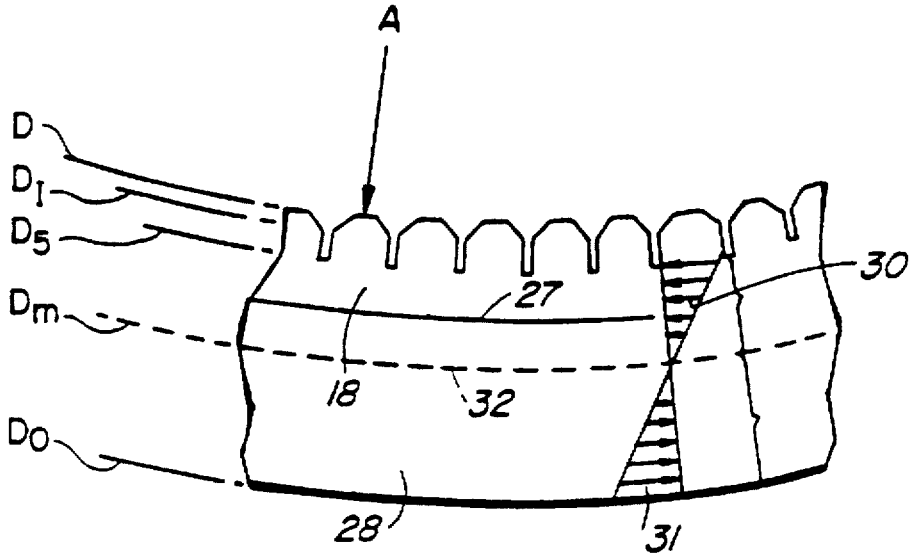
FIG. 11 is a diagrammatic cross-sectional representation showing the compression and tension forces developed upon rolling of a screen plate into a cylinder.
Figure 12:
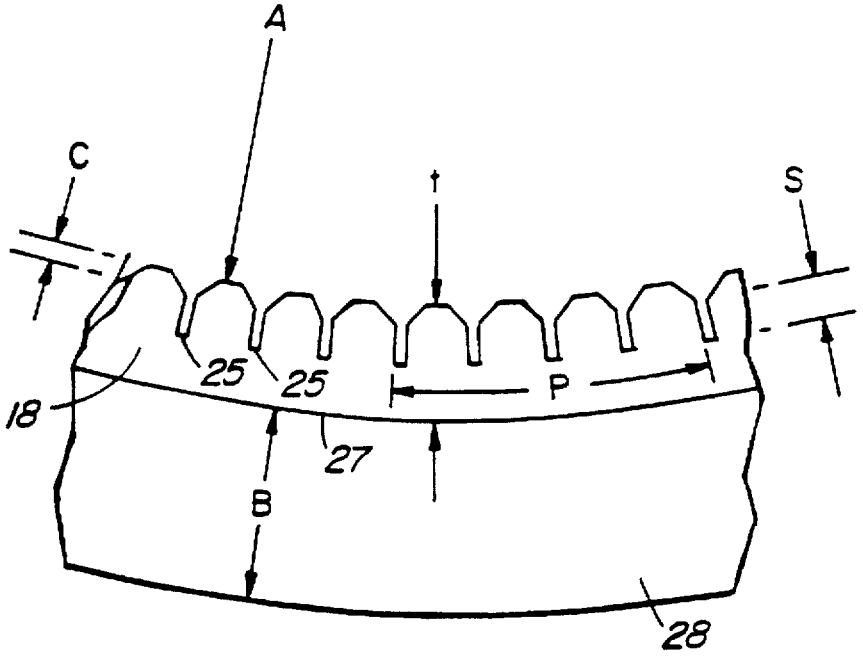
FIG. 12 is another diagrammatic cross-sectional representation being a reference drawing for an example of calculating the size of openings in the cylindric screen.

With the exception of FIGS. 11 and 12, which relate strictly to an example of calculation of certain features of the cylindric screens, the corresponding parts shown in the drawings are referred to with the same reference numerals for clarity, even where different embodiments of the screen plate may be shown.

DETAILED DESCRIPTION OF PREFERRED EMBODIMENTS

Figure 1:
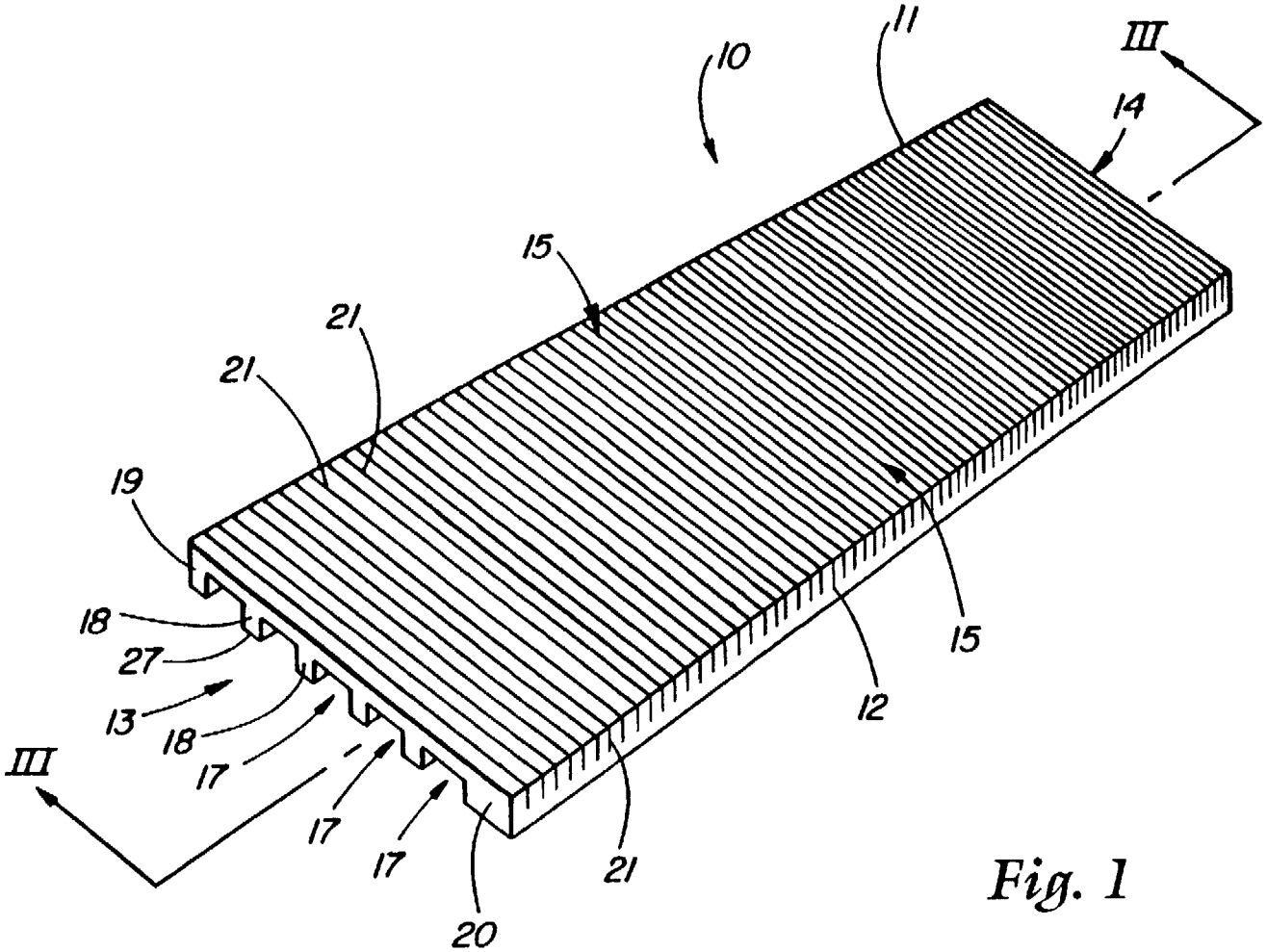
FIG. 1 is a simplified, diagrammatic perspective view showing a screen plate in the planar state and prior to the processing according to the present invention.
Figures 2, 4:
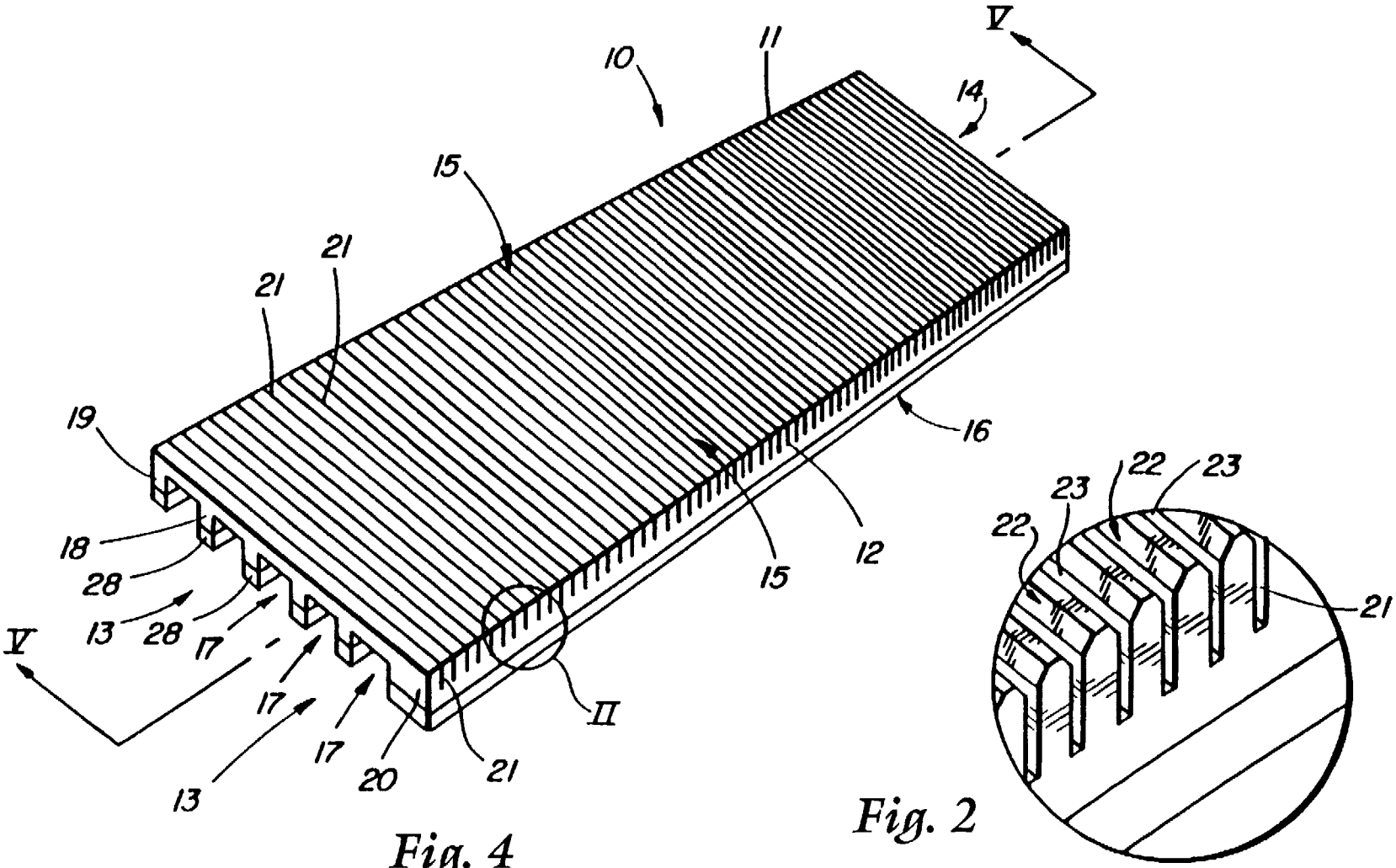
FIG. 2 is an enlarged detail II of FIG. 1.
FIG. 4 corresponds to FIG. 1 but shows the plate processed in accordance with the present invention.
Figure 3:
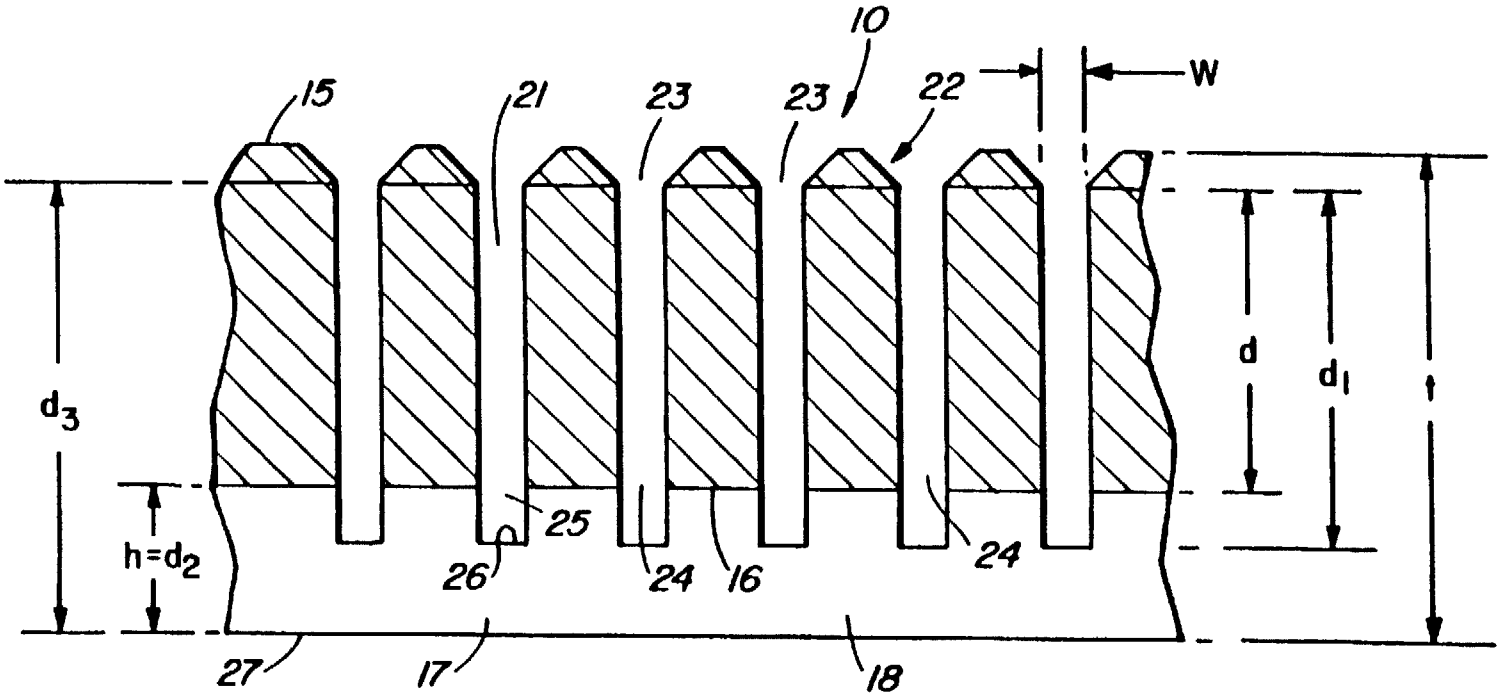
FIG. 3 is a part of section III—III of FIG. 1.

Referring now to FIGS. 1–3 of the drawings, FIG. 1 is a not-to-scale representation of a metallic screen plate, preferably a stainless steel plate. The plate is in the state where it has been machined according to the Frejborg '072 patent. The plate 10 is of a rectangular configuration, having a first side 11, an opposed second side 12, a first end 13 and an opposed second end 14. Reference numeral 15 designates an inner or inlet surface and number 16 is an opposed outlet surface. The term inlet and outlet in this context designates the flow of stock through the finished screen. The present invention relates only to those cylindric screens where the inlet side is the inner side of the cylinder, as shown, in FIG. 10 or 12.

The outlet surface 16 is formed by the bottoms of spaced apart grooves or channels 17 machined in the lower face of the plate 10 as viewed in FIG. 1. The channels 17 extend full length of the plate, from the first end 13 to the second end 14. A plurality of backing ribs 18 formed by the machining of the channels 17 separates the respective adjacent channels 17 from one another. In the embodiment shown in FIGS. 1–5, the ribs 18 are of rectangular cross-sectional configuration even though other shapes may be used if desired, as shown, by way of an example, in FIG. 8.

In the embodiment shown in FIGS. 1 and 4, there is also shown a first flange 19 at the first side 11 and a second flange 20 at the second side 12. For simplicity, the two flanges 19, 20 may be considered as presenting each just another one of the ribs 18 even though, strictly speaking, they do not separate two adjacent grooves 17 from each other.

Figure 9:
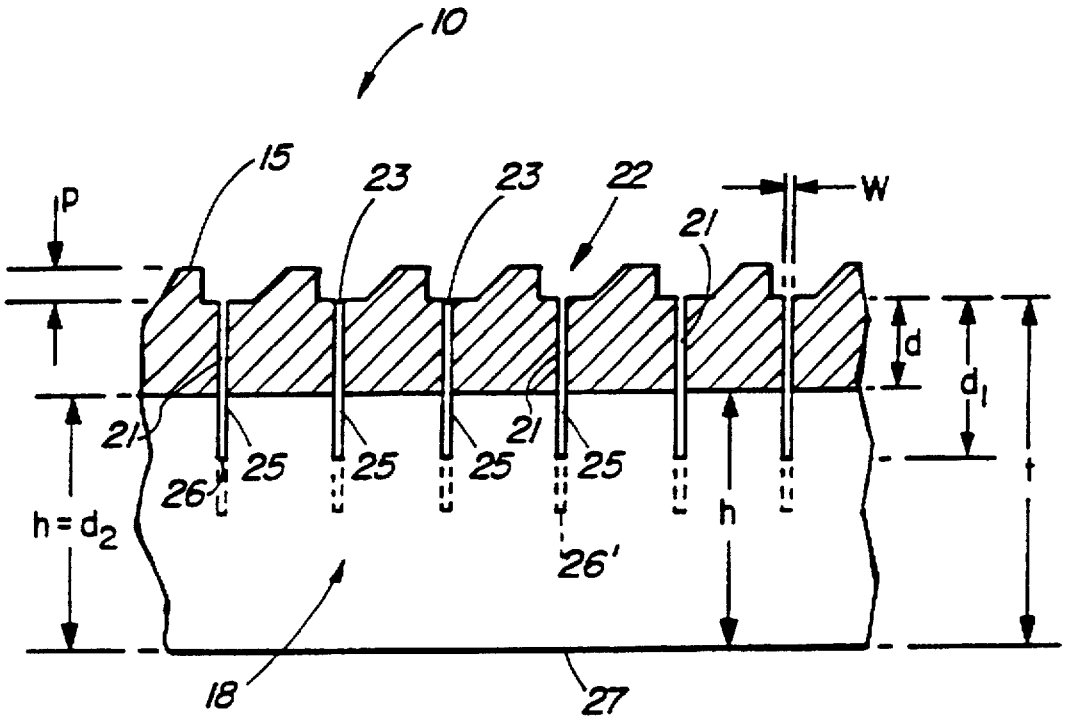
FIG. 9 is a partial diagrammatic cross-section similar to that of FIG. 3 but showing the use of the invention in another embodiment where a standard prefabricated plate may be used in making a screen cylinder having different size of the opening at the inlet of the slots.
Figure 10:
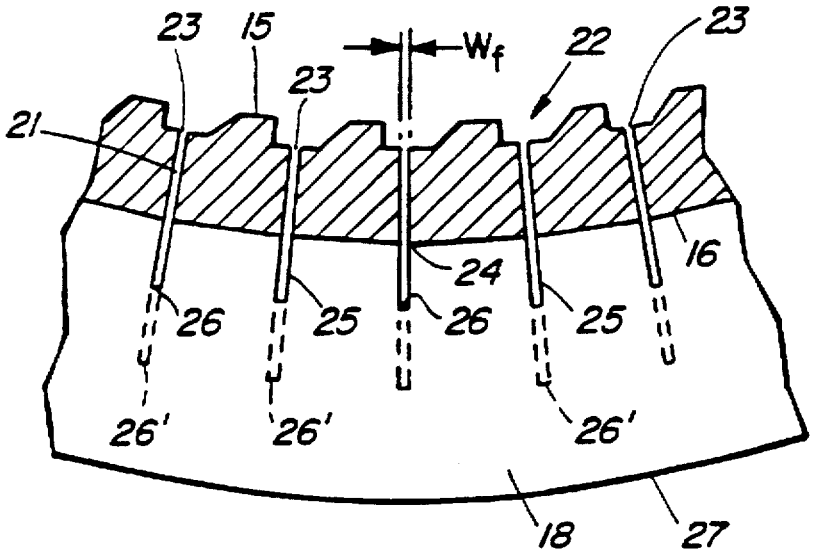
FIG. 10 is a partial cross-section similar to that of FIG. 9 but showing the plate in a rolled state.

The inlet surface 15 displays a plurality of straight slots 21 extending full width of the plate 10, from the first side 11 to the second side 12. Reference numeral 22 is a contoured groove which is shown (in FIGS. 2, 3 and 5) in a simplified shape having a generally V-shaped cross-section, with the inlet portion 23 of the slot 21 being at the bottom of the contoured groove 22. The actual shape and size of the contoured grooves may differ from that shown. One such different shape is shown in FIGS. 9–10. The shape of the contoured groove is optional and is not a part of the present invention.

Each slot 21 further defines an outlet portion 24 which coincides with the respective outlet surface 16, i.e. with the bottom of the respective groove or channel 17. The machining of the slots 21 is preferably carried out such that, at the point where each slot 21 intersects the respective backing rib 18, the slot 21 partly reaches into the material of the rib by way of an extension 25 of the slot, having a bottom 26. The extension 25 is, of course, open at both sides of the respective backing rib 18 to allow free flow of the accepted stock out of the extensions. Nevertheless, the extension 25 is hereafter also referred to as a "blind groove section 25" as the bottom 16 does present, at least technically, a groove rather than a slot when viewed in the direction of the flow of stock through the plate.

Figure 5:
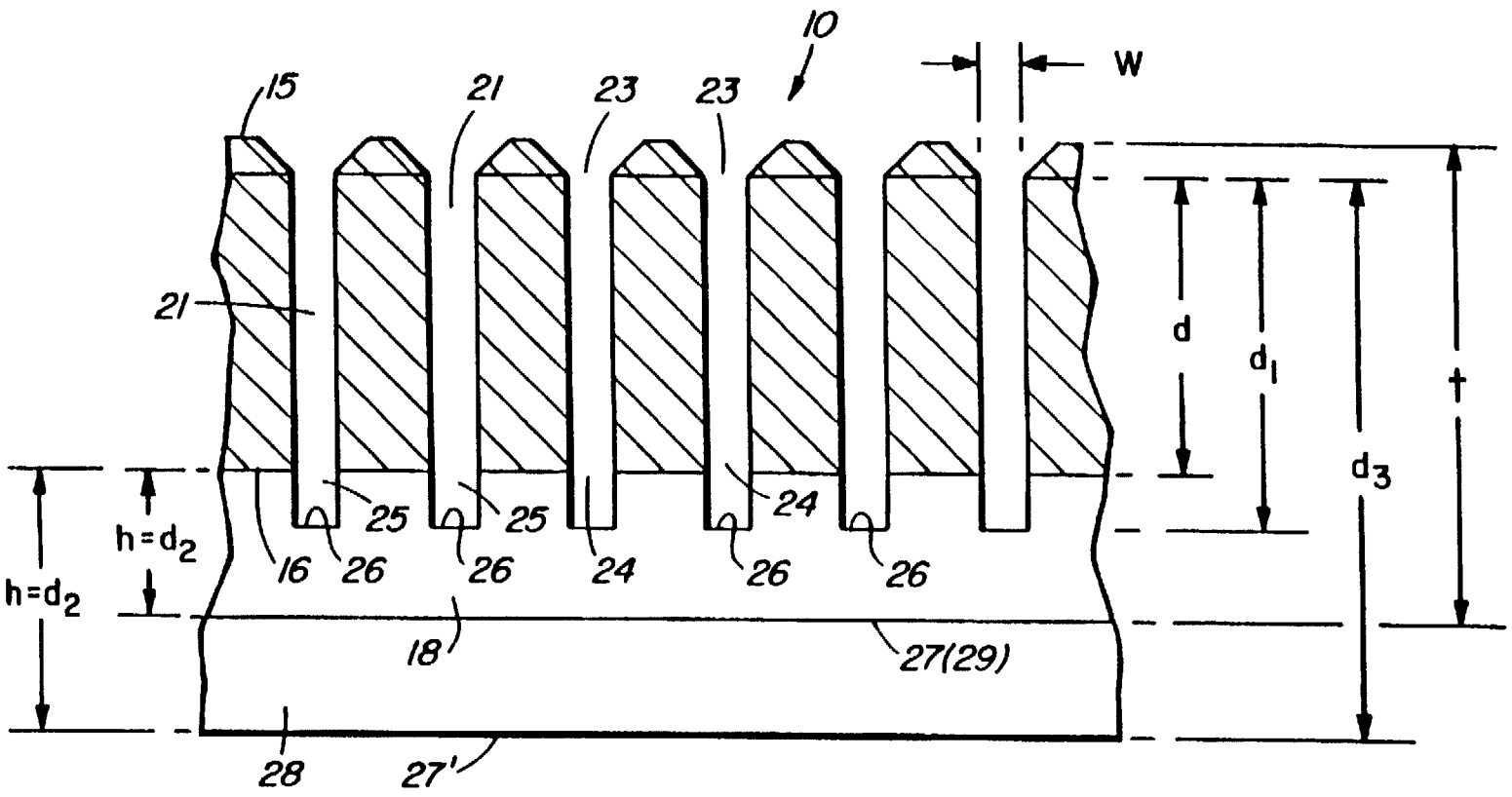
FIG. 5 is section V—V of FIG. 4.

The geometry of the size of the plate of FIGS. 1 or 4 is apparent from FIGS. 3 or 5, respectively. The symbols used in the drawings designate, respectively:

t the original thickness of the raw plate prior to machining;

h the height of the backing ribs 18 measured perpendicularly to the plate 10, i.e. the distance between the outlet surface 16 and a ridge section 27 of the backing rib 18;

w the width of the slots 21 before the plate is rolled into a cylindric shape;

$\Delta w$ the rate of change (reduction) of the width of the slots 21 upon rolling the plate into a cylinder screen;

$w_r$ the width of the slots at their inlet portions 23 reduced due to the material compression on rolling the plate into a cylinder, the width being equal to $w-\Delta w$;

d the distance between the inlet portion 23 of the slots to their respective outlet portion 24 at the outlet surface 16;

$d_1$ the depth of the slots 13 at the point of their intersection with the backing ribs 18;

$d_2$ the depth of the channels or grooves 17 (which is regularly generally equal to the height h defined above).

$d_3$ the distance measured across the thickness of the plate from the inlet portion 23 of the respective slot 21 to the ridge section 27 or 27'.

Let it now be assumed that the plate 10 of FIGS. 1–3 is to be used in providing a cylindric screen by rolling the plate 10 and welding or otherwise fixedly securing the ends 13, 14 to each other, as is well known in the art. Let it further be assumed that it is desired to use the screen in processing fibre or the like containing stock in which it would be of advantage to have, a reduced width of the inlets 23 of the slots 21 in order to provide a better screening effect. Prior art screens are limited in this respect by the particular thickness of the cutter used which determines the width w. After the rolling of the screen plate into a cylinder, there is a difference between the width w and the opening at the inlet portion 23 but no effort has been made thus far to selectively control this width by means other than the thickness of the cutter used in producing the slots 21.

The present invention presents a solution of this problem in a novel way, by determining and, if required, modifying, selected physical features of the screen plate and only then rolling the plate into a cylinder having a given diameter. The invention exploits the phenomena which occur on rolling the plate into a cylindric shape, namely that under otherwise even physical features of the plate of FIG. 3, the following applies:

(1) the smaller the diameter of the rolled screen, the larger the reduction of the width of the slot at the inlet 23;

(2) the deeper the depth $d_1$ of a given screen, the larger the reduction of the width of the slot at the inlet 23;

(3) the greater the height h, the larger the reduction of the width of the slot at the inlet 23;

(4) the larger the number of slots 21 per inch (the pitch), i.e. the denser the pattern of the slots 21, the lower the reduction of the width of the slot at the inlet 23.

Of the above conditions, item (1) has severe practical limitations as a substantial reduction of the diameter is not desirable since it goes hand-in-hand with the reduction of the area which is active in the screening operation, thus reducing the potential screening capacity of the screen. Also, when making a screen for an existing screening device, the diameter cannot be changed without changing other structural features of the screening machine, which may be difficult or even impossible.

The modification, particularly reduction of the pitch using condition (4) influences the effective screening area of a given cylinder, which may be undesirable. Thus, it often happens that—for practical reasons—the pitch is in fact a constant, which is usually in the range of 5 to 8 slots per inch.

The conditions (2) is more useful as it does not require a substantial modification of the structure of designing a cylindric screen. Obviously, the depth $d_1$ has practical limits beyond which the strength of the backing ribs 18 would be impaired.

The controlling of the height h of the backing ribs 18 using condition (3) for the purpose of controlling the final width of the inlets 23 of the slots 21 appears to require the least number of undesirable structural compromises when designing a cylindric screen of this type.

The invention therefore utilizes condition (2) or (3) of both as means for achieving the desired reduction of the width w at the inlet of the slot 21.

Realizing the possibility of controlling the eventual size of the inlets 23 of the slots 21 by using these two conditions, it can be seen that by merely changing the height of the backing rib 18 or by selecting the depth $d_1$ of the slot 23 one can effectively control the size $w_f$ at the inlet 23. In other words, the invention is based on utilizing the knowledge that the degree of reducing the width of the inlet 23 upon rolling the plate to a cylindric shape is proportional to (a) the height h of the ribs 18 and/or (2) the depth $d_1$ of the slots. All these variables, of course, refer to the plate in a flat state, prior to the rolling of same into a cylinder.

The desired height h of the rib may be provided by many different ways. For instance the thickness t of the plate prior to the machining of the grooves 17 and slots 21 can also be achieved such that the ribs of the desired height h are simply provided for by machining. This is diagrammatically shown in FIG. 6. This method is generally not preferred as it results in expensive machining and waste of material.

Figure 7:
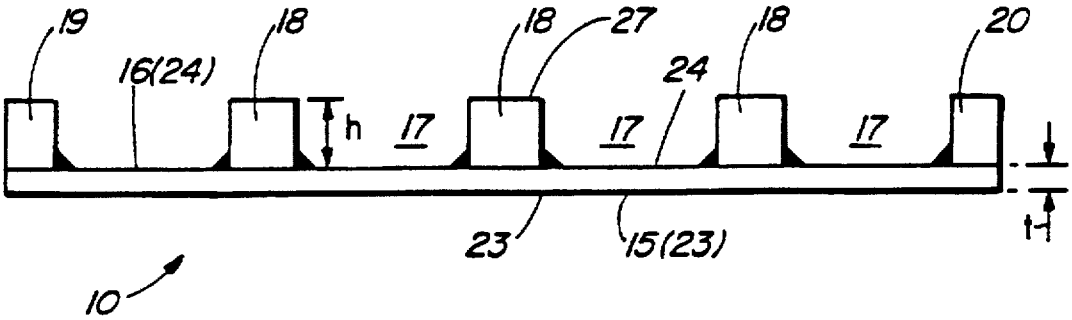
FIG. 7 is a view similar to that of FIG. 6 but showing another way of selectively providing the desired height of backing ribs of the screen produced according to the invention.

FIG. 7 shows another way, where the height of the ribs was determined by method hereafter described and the ribs 18 of the desired height h welded to a plate. Of course, the welding could be substituted by other known methods, if required, e.g. soldering, brazing, adhesive securing etc., without departing from the invention. This method results in savings of the material and machining costs, as minimum machining is required.

Figure 8:
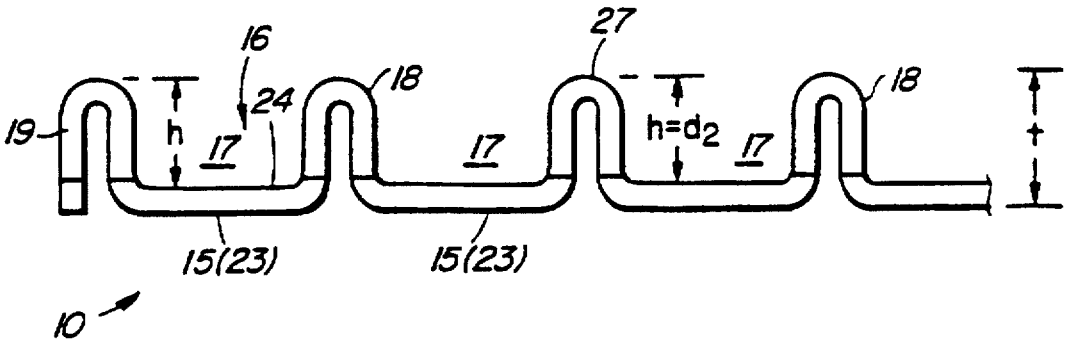
FIG. 8 is a view similar to that of FIG. 6 or FIG. 7, showing yet another way of selectively providing the desired height of backing ribs of the screen produced according to the invention.

FIG. 8 shows another way of producing the predetermined height h of the ribs 18, namely by rolling the stainless plate with U-shaped ridges having the desired height.

One of the preferred ways of selective control of the eventual size of the openings 23 is shown in FIGS. 1–5. Here, a plate is prefabricated with the channels 17 and ribs 18 and also includes the slots 21 and grooves 22. The slots 21 of this example are cut to a standard depth $d_1$. Assuming now that it is desired to reduce the size of the opening 23 to a value smaller than would normally be obtained upon rolling of the plate of FIG. 1 into a cylinder having a predetermined diameter, additional bars 28 having a predetermined height and defining a modified ridge section 27' are secured, in the example shown, welded, to the ridge sections 27 of the backing ribs 18, along weld seams 29 which coincide with the ridge section 27, as shown in FIG. 5. Thus, with otherwise unchanged physical features of the plate 10, the size $w_f$ of the inlet 23 is reduced by a predetermined rate. The welding of the additional bars 28 to the ribs 18 can be substituted by soldering, adhesive securement, brazing or by other methods.

FIG. 9 shows, in a diagrammatic fashion, that another way of controlling the ultimate width of $w_f$ is to select an appropriate depth $d_1$ of the blind groove sections 25 of the slots 21. Here, for practical reasons, the slots 21 are machined at a width w and the height h cannot be modified for reasons of structure of the machine in which the screen is used as a substitute. The ultimate width $w_f$ achieved with the blind groove sections 25 as shown in full lines would be too large for the desired screening effect. In accordance with the invention, the blind groove sections 25 are extended deeper into the backing ribs 18 to new bottoms 26' as shown by broken lines. As a result, on rolling the plate to a cylinder, the value of $w_f$ is smaller than it would have been with shallower slots 21–25.

Those skilled in the art are well aware that the last mentioned alternative has structural limitations as the primary purpose of the backing ribs 18 is to reinforce the screening cylinder which is typically subjected to considerable pressure load in operation.

The following Table of examples of application of the present invention is indicative of practical range of measurements for the purpose of this invention.

The values shown in the following table show the main field of commercial utilization of the present invention. They have been determined, by calculations explained later, with some of the figures having been verified on prototypes.

The values shown are based on a screen plate made from a stainless steel plate 0.400 in. (10 mm) thick, wherein the depth $d_1$ of the slots 21 was 0.200 in. (5 mm) and the depth of the grooves 22 at the inlet side of the plate was 0.045 in. (1.1 mm).

Figure 6:
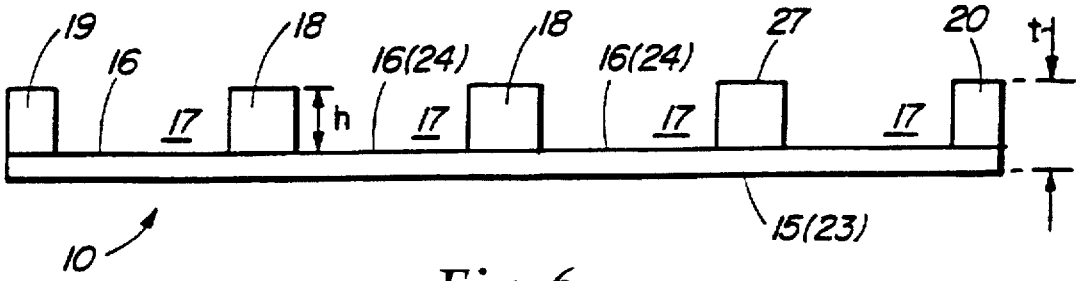
FIG. 6 is a diagrammatic representation of an end view of a plate showing an alternative way of providing the desired height of backing ribs of the screen produced according to the invention.

The backing ribs 18 have been welded to the plate prior to the machining, generally in the fashion shown in FIG. 6. The values in the columns headed by the pitch figures present the value Δw, i.e. the reduction in the width w of the slot 21 at its inlet 23 upon rolling of the plate into a cylinder having a diameter as set forth.

TABLE

| Screen Diameter | Backing Bars | 5 Pitch Δw | 6 Pitch Δw | 7 Pitch Δw | 8 Pitch Δw |
|---|---|---|---|---|---|
| 15" | none | .0067 | .0056 | .0048 | .0042 |
| 20" | none | .005 | .004 | .0036 | .003 |
| | 3/8" | .009 | .007 | .006 | .0055 |
| 24" | none | .0043 | .0036 | .003 | .0027 |
| | 3/8" | .0074 | .006 | .005 | .0046 |
| | 1/2" | .0084 | .007 | .006 | .005 |
| 30" | none | .0033 | .0027 | .0023 | .002 |
| | 3/8" | .006 | .005 | .004 | .0036 |
| | 1/2" | .0068 | .0057 | .0048 | .0042 |
| | 3/4" | .0084 | .007 | .006 | .005 |
| 36" | none | .0028 | .0023 | .002 | .0017 |
| | 3/8" | .005 | .004 | .0035 | .003 |
| | 1/2" | .0056 | .0047 | .004 | .0035 |
| | 3/4" | .007 | .0058 | .005 | .0043 |
| | 1" | .0084 | .007 | .006 | .0052 |

The values shown in the above Table can be determined in accordance with method described in the following Example.

FIGS. 11 and 12 are diagrammatic representations of a cylindric screen taken on a section line perpendicular to the axis of a cylindric screen. The symbols not used in previous figures and shown in FIG. 11 and 12 designate:

P=pitch (slots per inch)

D=inside diameter of screen $D_f$=diameter at the bottoms 26 of the extensions 25

$D_m$=diameter of the neutral axis

Do=diameter of the outermost ridges of the backing ribs

S=depth of slotting (equal to $d_1$ in the remaining figures)

C=depth of the contoured groove 22

T=thickness of original plate (corresponds to t in the other Figures)

B=height of the additional bar

It is to be noted in FIG. 11, that when a body such as a plate with the backing ribs 18 and additional bars 28 is rolled, compression forces are active in section 30 and tension forces act at section 31. The boundary 32 between sections 30, 31 is referred to as a >>neutral axis<<.

Problem:

What will be the rate of closing of the slots (Δw) if:

| | |
|---|---|
| 5 slots/in. are cut | P = 5 sl/in |
| plate rolled to 24" ID | D = 24 in. |
| depth of slots is 0.155 | S = 0.155 in. |
| depth of contour is 0.045" | C = 0.045 in. |
| original plate thickness 0.400 | T = 0.400 in. |
| height of backing bars ⅜" | B-0.375 in. |

Solution:

$$(1)\quad N = \text{total number of slots in one circumference} = P \times \pi D = 5 \times \pi \times 24 = 377 \text{ slots}$$

(2) The closing of the slots due to metal compression ($\Delta w_1$) is equivalent to the difference between the circumference at the bottom of the slots and the circumference at the neutral axis 32

$$\Delta w_1 = C_m - C_s$$

where $C_m$ is the circumference of the neutral axis 32; and $C_s$ is the circumference at the bottoms 25

$$C_s = \pi D_s = \pi(D + 2C + 2S)$$

$$C_s = \pi(24 + 2 \times .045 + 2 \times .155) = \pi \times 24.4 = 76.65 \text{ in.}$$

and $$C_m = \pi D_m = \pi\left[D_s + \frac{(D_o + D_s}{2}\right]$$

$$D_s = 24.4 \text{ in.}$$

$$D_o = D + 2T + 2B = 24 + 2 \times 0.4 + 2 \times 0.375 = 25.55 \text{ in.}$$

hence $$C_m = \left[24.4 + \left(\frac{25.55 - 24.4}{2}\right)\right] = \pi \times 24.975 = 78.46 \text{ in.}$$

Thus, $$\Delta w_1 = 78.46 - 76.65 = 1.81 \text{ in.}$$

For each slot it becomes $$\Delta w_{s1} = \frac{\Delta w_1}{N} = \frac{1.81}{277} = 0.0048 \text{ in/slot}$$

(3) The closing $\Delta w_2$ of the slot 21 due to geometry

This is equal to the difference between the circumference $C_s$, at the bottom 26 of the slots 21 and the circumference $C_i$ at the inlets 23 of the slots 21.

$$\Delta w_2 = C_s - C_i$$

where $$C_s = 76.65 \text{ in.}$$

and $$C_1 = \pi D_1 = \pi(D + 2C) = \pi(24 \times 2 \times 0.045) = \pi(24.09) = 75.68 \text{ in.}$$

$$\Delta w_2 = 76.65 - 75.68 = 0.97 \text{ in.}$$

The closing for each slot is $$\Delta w_{s2} = \frac{\Delta w_2}{N} = \frac{0.97}{377}$$

Finally, therefore:

$$\Delta w = \Delta w_{s1} + \Delta w_{s2} = 0.0048 + 0.0026 = 0.0074 \text{ in/slot}$$

It can be seen from the above that the present invention provides a significant advance in the art as it brings about the possibility of providing a controlled reduction of the size of the slots 21 at the inlets thereof by determining and providing either an additional bar to the backing ribs of the flat, unrolled screen, or by deepening the slots 21 to a depth suitable for attaining the desired result.

If desired, the backing ribs can also be reinforced after the rolling into a cylinder in which case the additional backing bars have no influence on the size of the openings 23 of the screening slots.

The invention provides the possibility of maintaining a reduced number of plates of different measurements each of which can be used to produce different fineness of the screening effect. The machining of the screens is also facilitated as regular, commercially available cutters can be used in the manufacture of screens where the screening slots have inlets of extremely fine size.

Those skilled in the art will appreciate that there are many ways of utilizing the invention which may differ, to a greater or lesser degree from the ways described above, without departing from the scope of the present invention. Accordingly, I wish to protect by letters patent which may issue on this application all such embodiments as fairly fall within the scope of my contribution to the art.

I claim:

1. A method of manufacturing a screen cylinder having a given inside diameter within the range of about 10 in. (250 mm) to about 60 in. (1500 mm), comprising the steps of:

(a) providing a generally rectangular metallic plate (10) having a known thickness t, a first end (13), a second end (14) and two opposed sides (11, 12), an inlet face (15) and an opposed, outlet face (16);

(b) providing in said outlet face (16) a plurality of generally straight, spaced apart channels (17) parallel with each other and being of a generally uniform depth ($d_2$), said channels (17) extending in the general direction from one said end (13) to the other (14), a rib (18) being disposed between each pair of adjacent channels (17), said ribs (18) having a predetermined height h measured in the direction perpendicular to the plate (10) and being generally equal to the depth $d_2$ of the channels;

(c) providing in said inlet face (15) a plurality of spaced apart, straight, continuous slots (21) having each a width w and extending full width of the plate (10), from the first side (11) of the plate to the second side (12), said slots (21) partially intersecting said ribs (18) to define therein blind groove sections (25) of the slots (21);

(d) rolling the plate (10) into a cylindric shape with said inlet face (15) inside and with said sides (11, 12) of the plate forming axial ends of the cylindric shape, thus reducing said width w of said straight, whereby said width w of said straight, continuous slots (21) is reduced; and (e) fixedly securing the ends (13, 14) of the plate (10) to each other to enclose said cylindric shape, characterized in that a desired rate of reduction $w_f$ of said width w is controlled by providing an appropriate height h of the ribs (18) from a formula:

$$h+\Delta h \propto \Delta w_f$$

wherein $\Delta h$ is an increase in the height h of the ribs; and $\Delta w_f$ is the desired reduction of the width w upon rolling the plate (10) into said cylindric shape, to reach $w_f$;

whereby the desired final width of the slots (21) in the cylindric shape can be modified by selecting said appropriate height h of the ribs, while working with the same original width of the slots (21) in the unrolled state.

2. The method of claim 1 characterized in that the controlling of the value of $w_f$ is effected by increasing the height h of the ribs (18), said slots (21) and said channels (17) being preferably disposed at about 90° to each other.

3. The method of claim 2, characterized in that the increasing of the height h is effected by fixedly securing to an outer surface (27) of at least some of the ribs (18) a metallic bar (28) whereby a relatively thin plate (10) can be used for making the screen cylinder while achieving a considerable narrowing of the width of the slots (21).

4. The method of claim 3, characterized in that the metallic bar (28) is welded to the outer surface (27) of the ribs (10).

5. The method of claim 3, characterized in that the metallic bar (28) is adhesively secured to the outer surface (27) of the ribs (10).

6. The method of claim 1, characterized in that (a) the thickness t of the metallic plate (10) prior to machining is within the range from about 0.125 in. (3 mm) to about 1 in. (250 mm);

(b) the width w of the slots in the plate (10) prior to the rolling is within the range of about 0.006 in (0.15 mm) to about 0.014 in. (0.35 mm);

(c) the depth $d_1$ of the slots (21) inclusive of a portion thereof (25) partially intersecting the ribs (18) is within the range from about 0.062 in. (1.5 mm) to about 0.250 in. (6 mm);

(d) the depth of the channels (17) and thus the height h of the ribs (18) is within the range from about 0.062 in. (1.5 mm) to about 0.875 in (22 mm);

(e) the pitch of the slots (21) is from about 4 to about 10 slots per inch (6 mm to 2.5 mm spacing).

7. A method of manufacturing a cylindric screen, comprising the steps of (a) providing an integral, metallic, generally planar, rectangular screen plate (10) having the length, as measured between its ends (13, 14), from about 33 in. (800 mm)to about 190 in. (4800 mm) which plate (10) includes:

(1) an inlet surface (15);

(2) an opposed outlet surface (16);

(3) a plurality of straight, parallel slots (21) extending from one side (11) of the plate (10) to the other (12), said slots (21) providing each a passage of a generally uniform cross-section through said plate (10), the slots (21) having each a width from about 0.006 in. to about 0.014 in., the spacing between the slots corresponding to a pitch of about 4 slots per inch (6 mm spacing) to about 10 slots per inch (2.5 mm spacing);

(4) a plurality of transversely disposed backing ribs (18) projecting from said outlet surface (16) and extending each from one end (13) of the plate (10) to the other (14), the height (h) of the ribs (18) as measured in the direction perpendicular to the plate being about 0.25 inch (6 mm);

(b) rolling the plate (10) into a cylinder where said inlet surface (15) is at the inside of the cylinder and the ends (13, 14) of the plate (10) define axial ends of the cylinder; and (c) fixedly securing the ends of the plate (10) to each other to enclose the cylinder;

characterized in that, prior to the rolling of the plate (10) into said cylindric shape, the height of each of said ribs (18) is increased to a total height from about 0.25 in. (6 mm) to about 1 in. (25 mm) by fixedly securing to an outer face (27) thereof an additional bar (28) of metallic material, whereby, upon rolling the plate (10) with thus modified height of said ribs 18, 28) into a cylindric shape, the width of the slots (21) at said inlet surface (15) is reduced by about 0.002 in. (0.05 mm) to about 0.010 in. (0.25 mm) depending upon the thickness of the plate (10), the diameter of the cylinder, the spacing between the slots (21) and the height of the backing ribs (18, 27).

8. A method of manufacturing a screen cylinder having a given inside diameter, said given inside diameter being within the range of about 10 in. (250 mm) to about 60 in. (1500 mm); said method comprising the steps of:

(a) providing a generally rectangular metallic plate (10) having a known thickness t, a first side (11 ), a second side (12) and two opposed ends (13, 14), the distance between the ends (13, 14) being the length of said plate (10), an inlet face (15) and an opposed, outlet face (16);

(b) providing the outlet face (16) with a plurality of straight, spaced apart backing ribs (18) extending from one end (13) of the plate (10) to the other (14) to thus provide, between said ribs (18), a plurality of generally straight, spaced apart channels (17) parallel with each other and having a generally uniform depth, (c) machining in said inlet face (15) a plurality of spaced apart, straight, continuous slots (21) disposed at an angle relative to the elongation of said channels (17), the slots (21) having a width w dependent on the cutting tool used in the machining, in the range from about 0.006 in. (0.15 mm) to about 0.014 in. (0.35 mm), the spacing between the slots (21) being in the range of about 4 slots per inch (6 mm spacing)to about 10 slots per inch (2.5 mm spacing), each slot (21) extending full width of the plate (10), from said first side (11) of the plate (10) to the second side (12), said slots (21) defining passages through said metallic plate (10) but only partly penetrating said backing ribs (18);

(d) rolling the plate (10) into a cylindric shape with said sides (11, 12) of the plate (10) forming axial ends of the cylindric shape; and (e) fixedly securing the ends (13, 14) of the plate (10) to each other to enclose said cylindric shape;

characterized in that (i) said ribs (18) have each a predetermined height h measured in the direction perpendicular to the plate (10);

(ii) and that said given width w of the slots (21) is a uniform minimum width of each said slot (21) having the magnitude $$(w-w_f)>O;$$

wherein $w_f$ is the desired width of each slot (21) at an inlet face (15) end of the slot upon rolling the plate (10) into a cylindric shape; and (iii) the height h of the ribs is determined from a relationship:

$$h+\Delta h\propto\Delta w_f$$

wherein $\Delta h$ is an increase in the height h of the ribs; and $\Delta w_f$ is the desired reduction of the width w upon rolling the plate (10) into a cylindric shape, to reach $w_f$.

9. The method of claim 8, characterized in that the backing ribs (18) are integral parts of the plate (10).

10. The method of claim 8, characterized in that the backing ribs (18) are fixedly secured to one of the outlet face of the plate (10).

11. The method of claim 8 characterized in that the backing ribs (18) have a generally U-shaped cross-section produced by forming of the plate (10) while it is in a generally flat, planar state, prior to step (a) whereby the ribs present a continuation of the sheet of the respective plate (10).

12. A cylindric screen produced by the method of claim 8, characterized in that it comprises a plurality of straight slot-shaped passages through a cylindric wall, said passages extending from the inlet face (15) of the screen to the outlet face (16) thereof, each passage (21) extending full axial length of the cylindric screen (10), and a plurality of backing ribs (18) being disposed peripherally at the outlet face (16) of the screen (10), each backing rib (18) being fixedly secured to an outer surface (16) of the cylindric wall and including a plurality of grooves (25), each groove (25) being parallel to and in register with one of said slots (21) to form a radial extension thereof into the respective rib (18).

13. A cylindric screen produced by the method of claim 8, characterized in that it comprises a plurality of straight slot-shaped passages (21) through a cylindric wall, said passages extending from the inlet face (15) of the screen to the outlet face (16) thereof, each passage (21) extending full axial length of the cylindric screen (10), and a plurality of backing ribs (18) being disposed peripherally at the outlet face (16) of the screen (10), each backing rib (18) being integral with an outer surface (16) of the cylindric wall and including a plurality of grooves (25), each groove (25) being parallel to and in register with one of said passages (21) to form a radial extension thereof into the respective rib (18).

14. A cylindric screen produced by the method of claim 8, characterized in that it comprises a plurality of straight slot-shaped passages (21) through a cylindric wall, said passages extending from the inlet face (15) of the screen to the outlet face (16) thereof, each passage (21) extending full axial length of the cylindric screen (10), and a plurality of backing ribs (18) being disposed peripherally at the outlet face (16) of the screen (10), each rib including a plurality of grooves (25), each groove (25) being parallel to and in register with one of said passages (21) to form a radial extension of the slots into walls of the respective channel (17).

15. A method of manufacturing a screen cylinder having a given inside diameter within the range of about 10 in. (250 mm) to about 60 in. (1500 mm), comprising the steps of:

(a) providing a generally rectangular plate (10) having a first end (13), a second end (14) and two opposed sides (11, 12), a first face (16) and an opposed, second face (15);

(b) said first face (16) being provided with a plurality of continuous, spaced apart ribs (18) each rib (18) having two sides and a ridge section (27), said ribs (18) being integral with or fixedly secured to the plate (10) at the first face (16), having a height h and being disposed in a substantially parallel, spaced apart relationship, the sides of the ribs (18) forming sides of channels (17) extending in the general direction from one said end (13) of the plate (10) to the other (14);

(c) each channel (17) thus having two opposed side walls formed by the sides of said ribs (18), and a bottom wall (16); the channels (17) having a predetermined depth $d_1$ generally corresponding to the distance between said bottom walls (16) and said ridge sections (27) of the ribs (18), and thus corresponding to said height h of the ribs (18);

(d) forming a plurality of parallel slots (21) extending full width of said plate (10), from one said side (11) to the other (12) and disposed at an angle to said channels (17), each slot (21) having an inlet portion (23) at said second face (15), and an outlet portion (24) at said first face (16);

(e) each slot (21) passing fully through said bottom walls (16) of said channels (17) and intersecting each said rib (18) by way of a blind groove section (25);

(f) each blind groove section (25) having a groove bottom (26) at a predetermined distance $d_2$ from the inlet portion (23) of the respective slot (21) as measured perpendicularly to the plate (10), the value of $d_2$ corresponding to the formula $$(d_3-d_2)\leqq h$$

wherein $d_3$ is the distance measured across the thickness of the plate (10), from the inlet portion (23) of the respective slot (21) to the ridge section (27) of the respective rib (18); and $d_2$ h are variables as described above; and (g) rolling the plate (10) into a cylinder wherein said sides are at respective axial ends of the cylinder; and (h) fixedly securing said ends to each other to enclose said cylinder;

said method being characterized in that a desired value of the reduction in the width of the slots (21) at said inlet portions (23) thereof upon rolling the plate (10) into said cylindric screen is effected by steps including the step of selecting the value of $(d_3-d_2)$ using the formula $$(d_3+d_2)\propto\Delta w_f;$$

wherein $\Delta w_f$ is the reduction in the width of the slots (21) at said inlet portion (23) upon rolling the plate (10) into a cylindric screen; and $d_2$ and $d_3$ are variables as described above.

16. The method of claim 15, characterized in that the value $\Delta w_f$ is increased by at least one of the following steps:

(i) increasing the magnitude of h; or (ii) decreasing the value of $d_2$.

17. The method of claim 16, characterized in that the increase of the value of $\Delta w_f$ is effected by using the step (i), the plate (10) being a metallic plate (10) and the magnitude of h being increased by fixedly securing, preferably welding, additional bars to the respective ridge sections.

* * * * *